United States Patent [19]

Street

[11] Patent Number: 4,753,693

[45] Date of Patent: Jun. 28, 1988

[54] METHOD FOR FORMING A VACUUM BONDED NON-WOVEN BATT

[75] Inventor: Robert L. Street, Rock Hill, S.C.

[73] Assignee: Cumulus Fibres, Inc., Charlotte, N.C.

[21] Appl. No.: 852,832

[22] Filed: Apr. 16, 1986

[51] Int. Cl.[4] ..... B32B 31/26; B65I 75/06

[52] U.S. Cl. ..... 156/62.8; 34/115; 34/121; 156/62.2; 156/285; 156/296; 156/308.2; 156/497

[58] Field of Search ..... 156/62.2, 62.4, 62.8, 156/285, 296, 308.2, 497; 264/119, 126; 34/113, 115, 114, 121

[56] References Cited

U.S. PATENT DOCUMENTS

| | | | |
|---|---|---|---|
| 2,500,282 | 3/1950 | Francis | 156/62.8 |
| 2,835,047 | 5/1958 | Fleissner et al. | 34/115 |
| 3,043,018 | 7/1962 | Fleissner | 34/115 |
| 3,196,555 | 7/1965 | Friedel et al. | 34/115 |
| 3,281,951 | 11/1966 | Greene | 34/121 |
| 3,362,079 | 1/1968 | Fleissner | 34/115 |
| 3,380,175 | 4/1968 | Fleissner et al. | 34/115 |
| 3,510,389 | 5/1970 | Olson | 156/296 |
| 3,616,031 | 10/1971 | Fleissner | 156/285 |
| 3,616,035 | 10/1971 | Basuerville et al. | 156/296 |
| 3,619,322 | 11/1971 | Fleissner | 156/62.2 |
| 3,765,971 | 10/1973 | Fleissner | 156/62.2 |
| 3,839,146 | 10/1974 | Fleissner | 34/115 |
| 4,377,615 | 3/1983 | Suzuki et al. | 156/176 |
| 4,463,048 | 7/1984 | Dickson et al. | 156/62.8 |

*Primary Examiner*—Jerome Massie

*Attorney, Agent, or Firm*—W. Thad Adams, III

[57] ABSTRACT

A method of forming a vacuum bonded non-woven batt includes the steps of blending at least first and second staple polymer fiber constituents. One of the fiber constituents has a relatively low predetermined melting temperature and the other a relatively high melting temperature. The intermixture is formed either into a relatively thick single layer web or a relatively thin web which is then formed into a relatively thick multilayer web structure. The web structure is positioned on a rotating, air permeable drum and a vacuum is used to substantially reduce the thickness and increase the density of the web structure. The web structure is heated to a temperature at or above the relatively low melting temperature of the first fiber constituent and below the melting temperature of the second fiber constituent while under vacuum to release the plastic memory of the fibers of the first fiber constituent in their compressed configuration. The two types of fibers are fused to themselves to form a batt having intimately interconnected and fused first and second fiber constituents. The apparatus on which the above method is performed includes a housing having two perforated counter-rotating drums positioned therein with vacuum means for applying a vacuum through the drum and through the web structure to reduce the thickness and increase the density of the web structure by vacuum pressure alone. Heating means heats the web structure as it is moved through the housing to release the plastic memory of the fibers of the first fiber constituent in their compressed configuration and fuse them to themselves and to the fibers of the second fiber constituent to form a relatively dense batt.

8 Claims, 4 Drawing Sheets

METHOD FOR FORMING A VACUUM BONDED NON-WOVEN BATT

TECHNICAL FIELD AND BACKGROUND OF THE INVENTION

This invention relates to a method and apparatus for forming, by means of vacuum, a non-woven batt. The batt is characterized by having a relatively high density which renders it suitable for uses such as mattresses, furniture upholstery and similar applications where substantial density and resistance against compression is desired, together with substantial resilience which will return the batt to its shape and thickness after compression for an indefinite number of cycles.

There are a number of advantages to be achieved by construction of batts for use as mattresses and upholstery from synthetic, staple fiber material. Such fibers are inherently lightweight and therefore easy to ship, store and manipulate during fabrication. These fibers are also generally less moisture absorbent than natural fibers such as cotton, or cellulosic based synthetic fibers such as rayon. Therefore, products made from these fibers can be maintained in a more hygienic condition and dried with much less expenditure of energy. Many such fibers also tend to melt and drip rather than burn. While some of these fibers give off toxic fumes, the escape of such fumes can be avoided or minimized by encapsulating the batt in a fire retardant or relatively air impermeable casing. In contrast, fibers such as cotton burn rapidly at high heat and generate dense smoke.

However, synthetic staple fibers also present certain processing difficulties which have heretofore made the construction of a relatively dense non-woven batt from synthetic staple fibers difficult and in some cases impractical. For example, the resiliency inherent in synthetic fibers such as nylon and polyester is caused by the plastic memory which is set into the fiber during manufacture. By plastic memory is meant simply the tendency of a fiber to return to a given shape upon release of an externally applied force. Unless the plastic memory is altered by either elevated temperature or stress beyond the tolerance of the fiber, the plastic memory lasts essentially throughout the life of the fiber. This makes formation of a batt by compressing a much thicker, less dense batt very difficult because of the tendency of the fibers to rebound to their original shape. Such fiber batts can be maintained in a compressed state, but this has sometimes involved the encapsulation of the batt in a cover or container. All of these methods create other problems such as unevenness and eventual deterioration of the batt due to fiber shifting, breakage and breakdown of the mechanical structure which maintains the compressed batt.

Not only are the batts themselves subject to numerous disadvantages, but the manufacturing processes known in the prior art are deficient in numerous respects. For example, insofar as is known all processes compress the batt into its desired density by use of engaging members such as rollers or plates on both sides of the batt. In effect, the batt is heated simultaneously from both sides to the point where its elastic memory is relaxed. However, the batt must then be removed from the rollers, plates or the like which have held the batt in its compressed state. Even with the use of TFE or other similarly coated rollers or plates, sticking is a common problem. In addition, even heating is inherently difficult to obtain since the fibers in contact with the heated metal surfaces are heated almost instantly whereas fibers in the interior of the batt are heated at a much slower rate. If the rollers between which the batt is traveling are heated to the extent necessary to completely relax the plastic memory of the fibers on the interior of the batt, quite often the fibers in intimate contact with the rollers will melt completely or disintegrate. If the rollers are cooled to avoid completely melting of the fibers on the outer surface of the batt, the interior fibers are not heated sufficiently to reset their plastic memory. In this event, the outer fibers are constantly being pushed against from the interior by fibers whose plastic memory is constantly attempting to cause the fibers to reassume their original shape. Attempts to correct this problem have included varying the percentage of fibers having relatively different melting temperatures through the cross-section of the batt or providing fibers on the interior of the batt having a relatively lower temperature at which the elastic memory is relaxed.

SUMMARY OF THE INVENTION

Therefore, it is an object of the invention to provide a method and apparatus for forming a vacuum bonded non-woven batt.

It is another object of the present invention to provide a method and apparatus for forming a vacuum bonded non-woven batt wherein the batt is evenly heated from one side to the other by heated air.

It is another object of the present invention to provide a method and apparatus for forming a vacuum bonded non-woven batt in which an even distribution of fibers throughout the batt can be achieved, It is yet another object of the invention to provide a method and apparatus for forming a vacuum bonded non-woven batt wherein the desired density and thickness of the batt can be maintained without physically compressing the batt between rollers, plates or the like.

These and other objects and advantages of the present invention are achieved in a method which comprises the steps of blending at least first and second staple polymer fiber constituents to form a homogeneous mixture of the fibers. The first fiber constituent has a relatively low melting temperature and the second fiber constituent has a relatively high melting temperature. A relatively thin web is formed of the blended fibers. Then, a plurality of these webs are used to form a relatively thick multilayer web structure. Alternately, a relatively thick, single layer structure can be formed.

The web structure is positioned on an air permeable support and a vacuum is applied through the multilayer web structure downstream from one side to the other and through the air permeable support sufficient to substantially reduce the thickness and increase the density of the multilayer web structure by vacuum pressure alone. The multilayer web structure is heated to a temperature at or above the relatively low melting temperature of the first fiber constituent and below the melting temperature of the second fiber constituent while under vacuum pressure. The plastic memory of the fibers of the first fiber constituent is reset.

The fibers of the first fiber constituent fuse to themselves and to the fibers of the second fiber constituent to form a batt having intimately interconnected and fused web layers and intimately interconnected and fused first and second fiber constituents. The multilayer web structure is then cooled to reset the plastic memory of the fibers of the first fiber constituent in their compressed state to form a batt having a density and thickness substantially the same as induced in the multilayer web structure by the vacuum.

The multilayer web structure is positioned on a perforated rotating metal drum. Preferably, two metal drums are used, with the multilayer web structure being first applied onto the first perforated rotating drum for a predetermined period of time and then onto the second, counter-rotating perforated drum whereby the thickness of the web is reduced and the density of the web increased uniformly throughout the thickness of the web structure by sequential passage of air through the web from first one side to the other and then on the second drum through the other side.

According to the embodiment disclosed, the web structure is heated by heating the air, movement of which through the web and the perforated rotating drums create the vacuum.

The thickness and density of the web structure is varied by varying the amount of vacuum applied to the web structure and the beginning thickness of the web structure itself. The distance of the first and second drums can be varied at the point of transfer of the web structure from the first to the second drum to correspond generally to the thickness of the web structure in order not to alter the orientation of the fibers in the web structure while the transfer is taking place.

The apparatus according to the present invention includes housing means. Air permeable support means are mounted in the housing means for carrying the multi-layer web structure, and vacuum means cooperate with the housing means and the air permeable support means to apply a vacuum through the multilayer web structure downstream from one side of the web to the other and through the air permeable support means sufficient to substantially reduce the thickness and increase the density of the multilayer web structure by vacuum pressure alone.

Heating means are provided for heating the multilayer web structure to a temperature at or above the relatively low melting temperature of the first fiber constituent and below the melting temperature of the second fiber constituent while under vacuum and in its reduced thickness state to release the plastic memory of the fibers of the first fiber constituent in their compressed configuration and fuse the fibers of the first staple fiber constituent to themselves and to the fibers of the second fiber constituent. The result is a batt having intimately interconnected and fused web layers and intimately interconnected and fused first and second fiber constituents.

Preferably, the air permeable support comprises first and second perforated, rotatably-mounted drums positioned in closely spaced-apart web transferring relation to each other. Preferably, adjustment means are provided for moving the axis of rotation of the first and second drums relative to each other for varying the distance between the adjacent surfaces of the first and second drums to correspond to the thickness of the web structure being carried on the drum. Preferably, the first drum is positioned to carry the web structure in a zone comprising approximately one half of its circumference. The second drum is positioned to carry the web structure received from the first drum in a zone comprising approximately one half of its circumference in diametrical opposition to the zone of the first drum carrying the web structure.

Cooperating stationary baffle means positioned within the first and second drums restrict vacuum flow through the first and second drums to the web structure carrying zone of the respective drums.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENT

Figure 1:
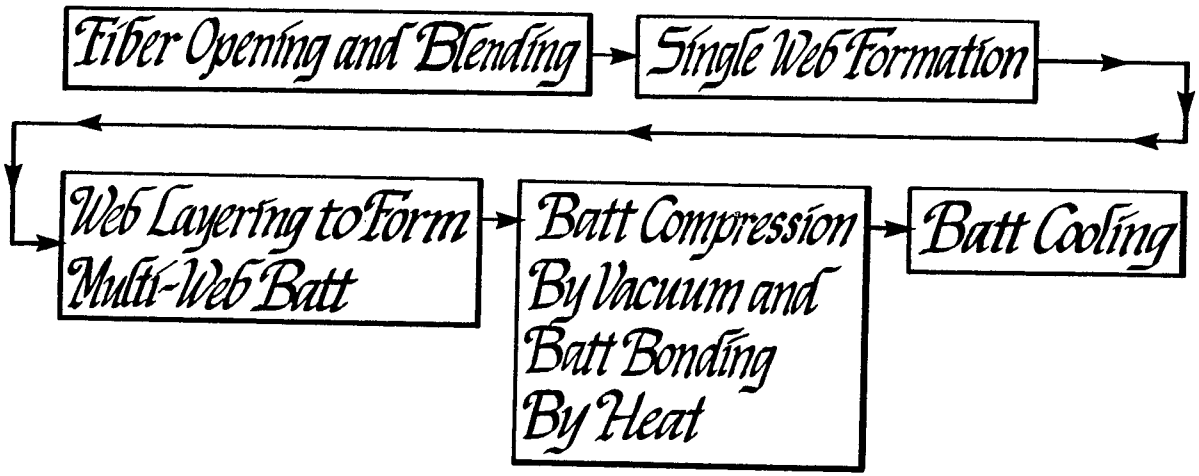
FIG. 1 is a block diagram of a method according to the present invention.

Referring now specifically to the drawings, a block diagram of the method according to the invention is provided in FIG. 1. The method begins by opening and blending suitable staple fibers. The staple fibers to be used are chosen from the group defined as thermoplastic polymer fibers such as nylon and polyester. Of course, other thermoplastic fibers can be used depending upon the precise processing limitations imposed and the nature of the compressed batt which is desired at the end of the process. For purposes of this application and to illustrate the process and the apparatus, the batt is constructed of 85 percent Type 430 15 denier, 3 inch (7.6 cm) staple polyester and 15 percent Type 410 8 denier 2 inch (5 cm) staple polyester, both manufactured by Eastman Fibers. The Type 430 polyester is a conventional polyester fiber which has a melting temperature of approximately 480° F. (249° C). As used in the specification and claims, this fiber is referred to as having a relatively high predetermined melting temperature as compared with the Type 410 low melt polyester which has a melting temperature of approximately 300° (149° C).

Low melt polyester of the type referred to above has a melting temperature of approximately 300° F. (149°

C.), but begins to soften and become tacky at approximately 240° to 260° F. (115°-127° C.).

As used in this application, however, the term melting does not refer to the actual transformation of the solid polyester into liquid form. Rather, it refers to a gradual transformation of the fiber over range of temperatures within which the polyester becomes sufficiently soft and tacky to cling to other fibers within which it comes in contact, including other fibers having its same characteristics and, as described above, adjacent polyester fibers having a higher melting temperature. It is an inherent characteristic of thermoplastic fibers such as polyester and nylon, that they become sticky and tacky when melted, as that term is used in this application. Also, thermoplastic fibers lose their "plastic memory" when thus heated. The process and apparatus described in this application take advantage of these two simultaneous occurrences by softening and releasing the plastic memory in the fibers having the relatively low melting temperature and causing these fibers to fuse to themselves and to the other polyester fibers in the mat which have not melted and which have not lost their plastic memory.

The opened and blended fiber intermixture is conveyed to a web forming machine such as a garnet machine or other type of web forming machine. As illustrated in this application, the thickness of a single web formed in the web formation step will be approximately ½ to ¾ of one inch (1.3-1.9 cm) thick, with a square foot (0.09 $m^2$) piece of the web weighing approximately ⅓ of an ounce (8.5 gm). However, an air laying machine, such as a Rando webber can be used to form a thick, single layer web structure. Further discussion relates to the multilayer web structure formed by a garnet machine.

Figure 2:
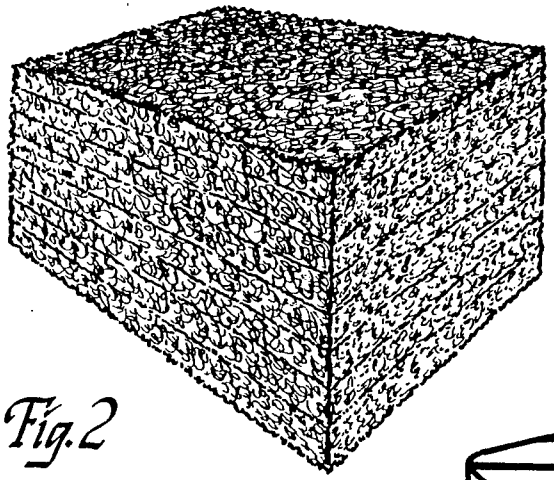
FIG. 2 is a perspective view of a multilayer web structure in its uncompressed state.

Once formed, the web is formed into a multilayer web structure by means of an apparatus which festoons multiple thicknesses of the web onto a moving slat conveyor in progressive overlapping relationship. The number of layers which make up the multilayer web structure is determined by the speed of the slat conveyor in relation to the speed at which successive layers of the web are layered on top of each other. In the examples disclosed below, the number of single webs which make up a multilayer web structure range between 6 and 28, with the speed of the apron conveyor ranging between 27 feet per minute (8.2 m/min) and 6 feet per minute (1.82 m/min). See FIG. 2.

Figure 9:
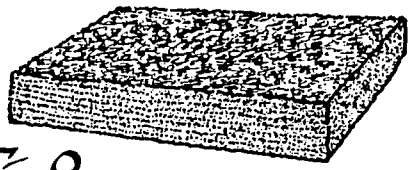
FIG. 9 is a perspective view of a batt formed according to the method and on the apparatus of the invention.

Once the multilayer web structure is formed, it is moved successively onto first and second rotating drums where the web structure batt is simultaneously compressed by vacuum and heated so that the relatively low melting point polyester melts (softens) to the extent necessary to fuse to itself and to the other polyester fibers having a relatively higher melting point. The structure is cooled to reset the plastic memory of the relatively low melting point polyester to form a batt having a density and thickness substantially the same as when the batt was compressed and heated on the rotating drums. See FIG. 9.

Figure 10:
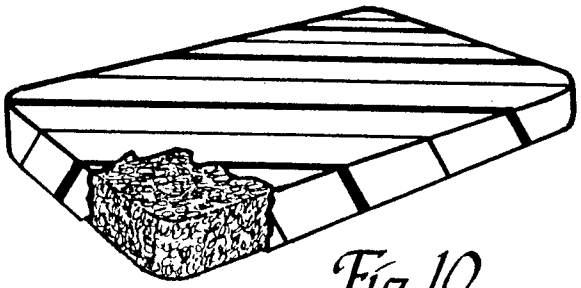
FIG. 10 is a perspective view of a batt in the form of a mattress with mattress cover thereon in accordance with the present invention.

Then, as desired, the batt may be covered with a suitable cover such as mattress ticking or upholstery to form a very dense and resilient cushion-like material. See FIG. 10.

The resulting construction offers substantial advantages over materials of equivalent density such as polyurethane foam. The resulting cushions or mattresses are usable in environments such as aircraft and prisons where a relatively high degree of fire retardancy and relatively low output of toxic fumes is desired. Polyester is particularly desirable from this standpoint, since it does not flash-burn and is self-extinguishing. When fully melted to liquid state, polyester drops off when exposed to flame or rolls, with a black, waxy edge forming along the effected area. By enclosing the entire batt within a cover, a much safer product than either foam or cotton is achieved.

Figure 3:
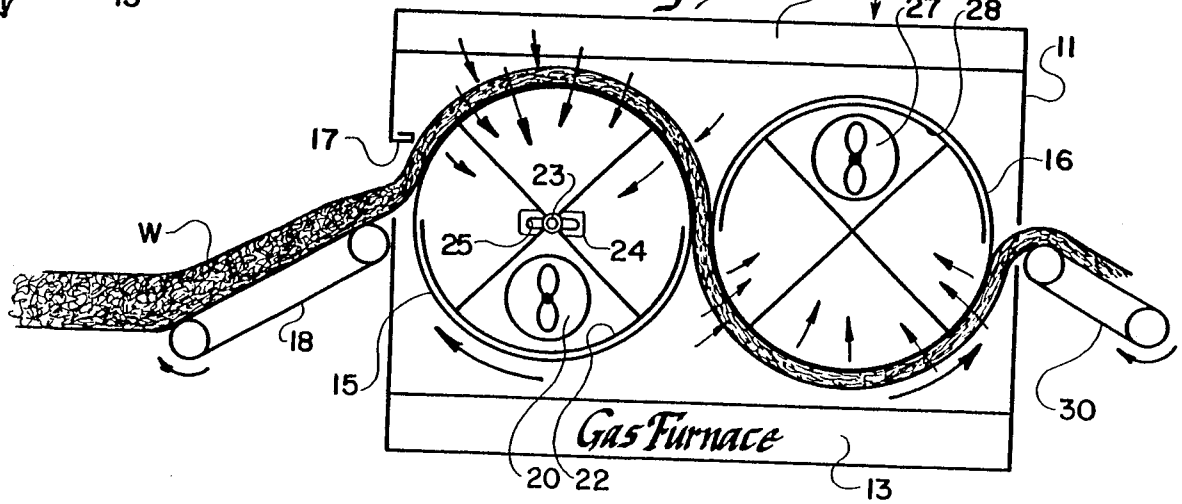
FIG. 3 is a fragmentary side elevational view of the apparatus according to the present invention.

Referring now to FIG. 3, an apparatus 10 according to the invention by which the method described above may be carried out is shown. Apparatus 10 includes a large substantially rectangular sheet metal housing 11, the upper extent of which comprises an air recirculation chamber. A one million BTU (252,000 kg-cal) gas furnace 13 is positioned in the lower portion of housing 11. Upward movement of the heated air from gas furnace 13 through the housing provides the heat necessary to soften and melt the polyester.

Figure 8:
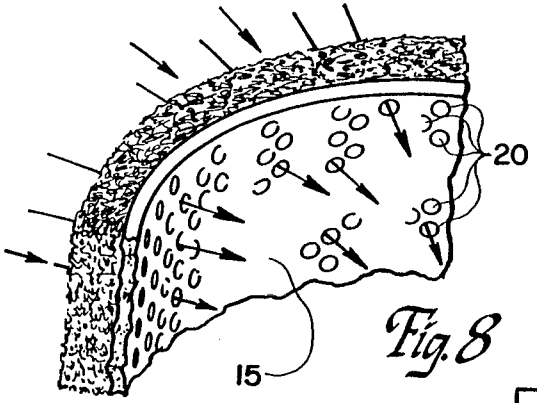
FIG. 8 is an enlarged, fragmentary perspective view showing the perforated surface of one of the drums with the vacuum-compressed multilayer web structure in position thereon.

Two counter-rotating drums 15 and 16, respectively, are positioned in the central portion of housing 11. Drum 15 is positioned adjacent an inlet 17 through which the multilayer web structure W is fed. The web structure is delivered from the upstream processes described above by means of a feed apron 18 through inlet 17. Drum 15 is approximately 55 inches (140 cm) in diameter and is perforated with a multiplicity of holes 20 (see FIG. 8) in the surface to permit the flow of heated air.

In the embodiment illustrated in this application, the drum has thirty holes per square inch (4.7 per sq. cm) with each hole 20 having a diameter of three thirty-seconds of an inch (2.4 mm).

A suction fan 21 preferably having a diameter of 42 inches (107 cm) is positioned in communication with the interior of drum 15. As is also shown by continued reference to FIG. 3, the lower one half of the circumference of drum 15 is shielded by an imperforate baffle 22 so positioned inside drum 15 that suction-creating air flow is forced to enter drum 15 through the holes 20 in the upper half.

Drum 15 is also mounted for lateral sliding movement relative to drum 16 by means of a shaft 23 mounted in a collar 24 having an elongate opening 25. Once adjusted, shaft 23 can be locked in any given position within collar 24 by any conventional means such as a locking pillow block or the like. (Not shown).

Drum 16 is mounted immediately downstream from drum 15 in housing 11. Drum 16 includes a ventilation fan 27, also having a diameter of 42 inches (107 cm). Note that fans 21 and 27 are shown in FIG. 3 in reduced size for clarity. An imperforate baffle 28 positioned inside drum 16 and enclosing the upper half of the circumference of drum 16 forces suction creating air flow to flow through the holes 20 in the lower half of the drum surface. Preferably, the drum 16 contains the same number and size holes 20 as described above with reference to drum 15. The exiting batt is simultaneously cooled and carried away from housing 11 by a feed apron 30.

Figure 4:
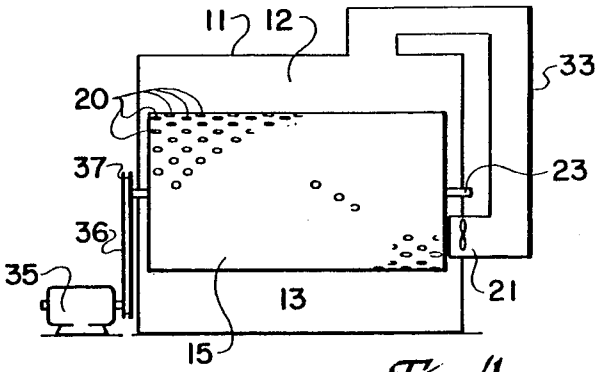
FIG. 4 is a fragmentary end elevational view showing one of the rotating drums with associated drive and vacuum components.
Figure 11:
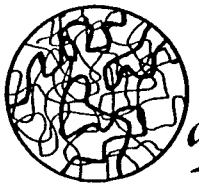
FIG. 11 is a magnified section in a single plane of the fiber structure of a batt according to the present invention.

Both drums are ventilated and driven in the manner shown in FIG. 4. As is shown specifically with reference to drum 15, fan 21 recirculates heated air back to the ventilation chamber of 12 of housing 11 by means of a recirculating conduit 33. Drum 15 is driven in a conventional manner by means of an electric motor 35 connected by suitable drive belting 36 to a drive pulley 37.

Referring again to FIG. 3, multilayer web structure W in uncompressed form enters housing 11 through inlet 17. Suction applied through the holes 20 in drum 15 immediately force the web structure W tightly down onto the rotating surface of drum 15 and by air flow through the holes 20 and through the porous web structure. As is apparent, the extent to which compression takes place at this point can be controlled by the suction exerted through drum 15 by fan 21. The air temperature is approximately 325° F. (163° C.).

By continued reference to FIG. 3, it is seen that one side of the mat is in contact with drum 15 along its upper surface. At a point between drum 15 and drum 16, the web is transferred to drum 16 so that the other side of the web is in contact with the surface of drum 16 and the surface which was previously in contact with drum 15 is now spaced-apart from the surface of drum 16. In effect, a reverse flow of air is created. It has been found that an extraordinarily uniform degree of heating takes place by doing this. Therefore, the polyester fibers having a relatively low melting temperature can be melted throughout the thickness of the web without any melting of the polyester fibers having the relatively high melting temperature.

Figure 5:
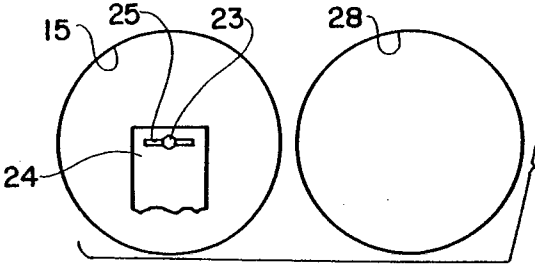
FIG. 5 is a schematic view showing the two drums in a given intermediate spaced-apart relation.
Figure 6:
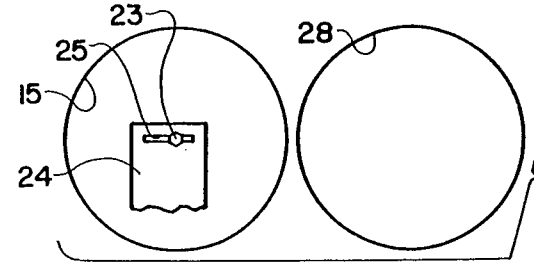
FIG. 6 is a view similar to FIG. 5 showing the two drums in a closer spaced-apart configuration for producing a relatively thinner batt.
Figure 7:
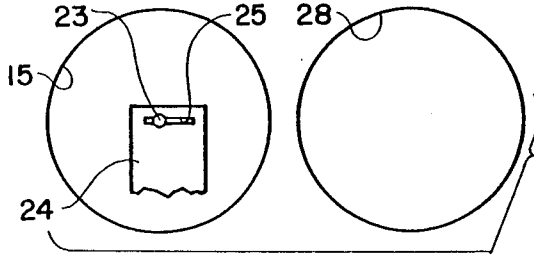
FIG. 7 is a view similar to FIG. 5 showing the two drums in a relatively further spaced-apart configuration for producing a relatively thicker batt.

In order to maintain constant vacuum pressure on the web throughout the housing, it is important that intimate contact between the web structure and either drum 15 or 16 be maintained at all times. To do this, it is important that a gap not be created at the point of transfer of the web structure between drum 15 and drum 16. For example, if the space between the adjacent surfaces of drum 15 and 16 was 5 inches (12.7 cm) and the thickness of the web being transferred at that point was only 3 inches (7.6 cm), a relatively thin length of drum surface on both drums 15 and 16 would be exposed to the free flow of air therethrough. The unrestricted flow of air could damage the web structure. Furthermore, vacuum would not be exerted on the web for a portion of the distance between drum 15 and 16, thereby allowing the polyester fibers having the relatively high melting temperature and which still retain their plastic memory to begin to resume their uncompressed state. This would cause undesirable movement between the softened low melt polyester fibers and the adjacent polyester fibers having the higher melting temperature. Therefore, shaft 23 is adjusted in opening 24 as is illustrated in FIGS. 5, 6 and 7. The adjustment is made according to the thickness of the web being processed so that the distance between adjacent surfaces of drum 15 and 16 very closely approximate the thickness of the web in its compressed state as it is transferred from drum 15 to drum 16.

Assuming a web thickness of 4 inches (10 cm) in its compressed state on drum 15, the distance between adjacent surfaces of drums 15 and 16 in FIG. 5 would be 4 inches (10 cm). To manufacture a web having less thickness, drums 15 and 16 would be moved closer together by sliding shaft 23 forward in opening 24 so that, for example, the distance between drums 15 and 16 would be 2 inches (5 cm) when processing a 2 inch (5 cm) web. Conversely, to process a thicker web, shaft 23 would be moved rearwardly in opening 24 thereby moving drum 15 away from drum 16 so that, again, the thickness of the distance between adjacent surfaces of drums 15 and 16 closely approximates the thickness of the web in its compressed state. It is important to note that the web structure is *not* being compressed by the adjacent drum surfaces at this point. Compression continues to occur only because of vacuum pressure.

As noted above, a wide variety of high density batts can be created by altering the manufacturing of variables in many different ways. In the table that follows, only a few of the many possible processing combinations are illustrated. In the following examples, note the dramatic increase in air flow consistent with the decrease in the input web thickness even though lower fan rpms are needed.

TABLE I

| FINISHED PRODUCT DENSITY oz./ft$^3$ & (kg/m$^3$) | FINISHED PRODUCT THICKNESS inches (cm) | INPUT WEB THICKNESS inches (cm) | NO. OF LAYERS | TOTAL FAN CAPACITY CFM (M$^3$/sec) | FAN RPM | APRON SPEED ft/min (m/min) | AIR TEMP. °F. (°C.) |
|---|---|---|---|---|---|---|---|
| 22.2 | 4.4 (11) | 20 (51) | 28 | 5,000 (2.36) | 800 | 6.0 (1.82) | 325 (163) |
| 24 | 3.5 (8.9) | 18.5 (47) | 26 | 4,800 (2.26) | 850 | 6.5 (1.98) | 325 (163) |
| 20 | 3.0 (7.6) | 13.5 (34) | 18 | 7,500 (3.54) | 700 | 9.0 (2.74) | 325 (163) |
| 19 | 2.0 (5.1) | 9.0 (23) | 12 | 8,000 (3.78) | 600 | 13.0 (3.96) | 325 (163) |
| 20 | 1.0 (2.5) | 5.0 (13) | 6 | 10,000 (4.72) | 550 | 27.0 (8.2) | 325 (163) |

Once the batt leaves housing 11 it cools very rapidly into a dense batt having the same thickness as when processed in housing 11. Cooling resets the plastic memory of the low melt polyester fibers, fusing the low melt polyester fibers to themselves and also to the fibers having the relatively higher melting temperature. Because of the compression created by the vacuum, many fibers from adjacent web layers fuse to each other. The result is a homogeneous structure which, from visual observation, does not appear to have been constructed from a plurality of thinner layers. (See FIG. 9). The batt processed on the apparatus and according to the method described above therefore has fibers with plastic memories set at two different temperatures. The plastic memory of the low melting point fibers act as springs to pull the batt into a compressed state. The plastic memory of the fibers having the higher melting temperature urge the batt to expand but are prevented from doing so by the low melt fibers. The result is a batt which, while being held in a relatively dense, compressed state nevertheless has considerable resiliency.

A method and apparatus for forming a vacuum bonded non-woven batt is described above. Various details of the invention may be changed without departing from its scope. Furthermore, the foregoing description of the preferred embodiment according to the present invention is provided for the purpose of illustration only and not for the purpose of limitation—the invention being defined by the claims.

I claim:

1. A method of constructing a high density resilient batt comprising the steps of:

(a) blending at least first and second staple polymer fiber constituents to form a homogeneous intermixture of said fibers, said first fiber constituent having a low predetermined melting temperature and said second fiber constituent having a high predetermined melting temperature;

(b) forming a web of said blended fibers;

(c) overlaying a plurality of said webs to form a thick multilayer web structure having homogeneous layers of the same first and second staple fibers throughout its thickness;

(d) positioning said multilayer web structure on an air permeable support;

(e) applying a vacuum through said multilayer web structure downstream from one side of the web to the other and through said air permeable support sufficient to substantially reduce the thickness and increase the density of the multilayer web structure uniformly throughout the thickness of the web structure by vacuum pressure alone;

(f) heating the multilayer web structure to a temperature at or above the low melting temperature of said first fiber constituent and below the melting temperature of said second fiber constituent while under vacuum and in its reduced thickness state to release the plastic memory of the fibers of siad first fiber constituent in their compressed configuration and fuse the fibers of said first fiber constituent to themselves and to the fibers of the second fiber constituent to form a batt having intimately interconnected and fused web layers and intimately interconnected and fused first and second fiber constituents; and (g) cooling the multilayer web structure to reset the plastic memory of the fibers of said first fiber constituent to form a batt having a density and thickness substantially the same as induced in said multilayer web structure by the vacuum.

2. A method of constructing a high density resilient batt comprising the steps of:

(a) blending at least first and second staple polymer fiber constituents to form a homogeneous intermixture of said fibers, said first fiber constituent having a low predetermined melting temperature and said second fiber constituent having a high predetermined melting temperature;

(b) forming a thick web of said blended fibers into a web structure having at least one homogeneous layer throughout the thickness of the web structure;

(c) positioning said web structure on an air permeable support;

(d) applying a vacuum through said web structure downstream from one side of the web to the other and through said air permeable support sufficient to substantially reduce the thickness and increase the density of the web structure uniformly throughout the thickness of the web structure by vacuum pressure alone;

(e) heating the web structure to a temperature at or above the low melting temperature of said first fiber constituent and below the melting temperature of said second fiber constituent while under vacuum and in its reduced thickness state to release the plastic memory of the fibers of said first fiber constituent in their compressed configuration and fuse the fibers of said first fiber constituent to themselves and to the fibers of the second fiber constituent to form a batt having intimately interconnected fused first and second fiber constituents; and (f) cooling the web structure to reset the plastic memory of the fibers of said first fiber constituent to form a batt having a density and thickness substantially the same as induced in said web structure by the vacuum.

3. A method of constructing a high density resilient batt according to claim 1 or 2, wherein the step of positioning the web structure on an air permeable support comprises positioning the web structure on a perforated rotating metal drum.

4. A method of constructing a high density resilient batt according to claim 1 or 2, wherein the step of positioning the web structure on an air permeable support comprises the step of applying the web structure onto a first perforated rotating drum for a predetermined period of time and then the other side of the web structure onto a second, counter-rotating perforated drum whereby the thickness of the web is reduced and the density of the web increased by sequential passage of air through the web from both sides to the other.

5. A method of constructing a high density resilient batt according to claim 4, wherein transfer of the web from the first drum to the second drum occurs at the point of closest proximity between the two drums to assist in maintaining vacuum pressure on the web structure during transfer.

6. A method of constructing a high density resilient batt according to claim 1 or 2, wherein the step of heating the web structure is accomplished by heating the air, movement of which through the web and air permeable structure support creates the vacuum.

7. A method of constructing a high density resilient batt according to claim 4, wherein the thickness and density of the web structure is varied by varying the amount of vacuum applied to the web structure, and further wherein the distance between the first and second drums is varied at the point of transfer of the web structure from the first to the second drum to correspond generally to the thickness of the web structure whereby the orientation of the fibers in the web structure is not altered by the transfer of the web structure from the first to the second drum.

8. A method of constructing a high density resilient batt comprising the steps of:

(a) blending at least first and second staple polymer fiber constituents to form a homogeneous intermixture of said fibers, said first fiber constituent comprising polyester having a low predetermined melting temperature and said second fiber constituent comprising polyester having a high predetermined melting temperature;

(b) forming a thin web of said blended fibers;

(c) overlaying at least six of said webs to form a thick multilayer web structure having homogeneous layers of the same first and second fibers throughout its thickness and having a density of approximately four ounces per cubic foot;

(d) positioning said multilayer web structure on an air permeable support;

(e) applying a vacuum through said multilayer web structure downstream from one side of the web to the other and through said air permeable support sufficient to reduce the thickness of the web structure 75% and increase the density of the multilayer web structure 400% uniformly throughout the thickness of the web structure by vacuum pressure alone;

(f) heating the multilayer web structure to a temperature at or above the low melting temperature of said first fiber constituent and below the melting temperature of said second fiber constituent while under vacuum and in its reduced thickness state to release the plastic memory of the fibers of said first fiber constituent in their compressed configuration and fuse the fibers of said first fiber constituent to themselves and to the fibers of the second fiber constituent to form a batt having intimately interconnected and fused web layers and intimately interconnected and fused first and second fiber constituent; and (g) cooling the multilayer web structure to reset the plastic memory of the fibers of said first fiber constituent to form a batt having a density and thickness substantially the same as induced in said multilayer web structure by the vacuum.

* * * * *